United States Patent [19]

Pyzewski

[11] 4,149,348

[45] Apr. 17, 1979

[54] MULTIPLE GLAZED UNIT HAVING INNER SHEET MOUNTED WITHIN A SPACER

[75] Inventor: Stanley J. Pyzewski, Cheswick, Pa.

[73] Assignee: PPG Industries, Inc., Pittsburgh, Pa.

[21] Appl. No.: 815,980

[22] Filed: Jul. 15, 1977

[51] Int. Cl.[2] ..... E06B 5/20; E06B 3/24

[52] U.S. Cl. ..... 52/172; 52/308; 52/399; 52/788; 52/790; 428/34; 156/109

[58] Field of Search ..... 52/397–403, 52/616, 304, 171, 172, 202, 308; 428/34; 156/109

[56] References Cited

U.S. PATENT DOCUMENTS

| | | | |
|---|---|---|---|
| 3,544,294 | 1/1970 | Goto | 428/34 |
| 3,837,129 | 9/1974 | Losell | 52/616 |
| 3,872,198 | 3/1975 | Britton | 52/304 |
| 3,928,923 | 12/1975 | Mazzoni et al. | 52/616 |
| 4,047,351 | 9/1977 | Derner et al. | 428/34 |

FOREIGN PATENT DOCUMENTS

| | | | |
|---|---|---|---|
| 514785 | 10/1952 | Belgium | 428/34 |
| 532101 | 8/1955 | Italy | 428/34 |

*Primary Examiner*—James L. Ridgill, Jr.
*Attorney, Agent, or Firm*—Donald Carl Lepiane

[57] ABSTRACT

A triple glazed unit has the inner glass sheet mounted within a spacer and outer glass sheets mounted on opposed outer surfaces of the spacer. The peripheral edge portions of the outer glass sheets extend beyond the spacer to form a peripheral channel. A moisture-resistant adhesive fills the peripheral channel to seal the unit and provide dead airspaces between the glass sheets.

16 Claims, 11 Drawing Figures

MULTIPLE GLAZED UNIT HAVING INNER SHEET MOUNTED WITHIN A SPACER

BACKGROUND OF THE INVENTION

1. Field of the Invention:

This invention relates to a multiple glazed unit and more particularly to a multiple glazed unit having inner glass sheet(s) mounted within a spacer.

2. Discussion of the Prior Art and Technical Problems:

Multiple glazed units having three or more transparent sheets are known in the prior art and taught in U.S. Pat. Nos. 2,235,680; 2,525,717; 2,741,809; 2,838,809; 2,883,718; 2,934,801; 2,966,435; 3,544,294; 3,837,129 and 3,872,198 to name a few.

In general, U.S. Pat. Nos. 2,741,809; 2,838,809; 2,934,801; 2,966,434 and 3,544,294 each teach a multiple glazed unit having a plurality of glass sheets separated by a spacer positioned between adjacent glass sheets. Although the multiple glazed units taught in the above-mentioned patents are acceptable, they are expensive to construct. More particularly, positioning a spacer between adjacent glass sheets requires two spacers for a triple glazed unit thereby increasing material costs. Further, increased time is required to construct two spacers and mount them between adjacent glass sheets than to construct one spacer. This cost in material and time increases as the number of glass sheets employed increases.

U.S. Pat. Nos. 2,525,717; 2,883,718; and 3,872,198 each teach a multiple glazed unit having three glass sheets separated by a spacer. In general, the spacer has a base having a plurality of grooves for receiving edge of a glass sheet. In order to form a good hermetic seal, close tolerances between walls of the groove and adjacent surfaces of the glass sheet mounted therein must be maintained to avoid formation of voids in the seal. If voids are present, air will move between the glass sheets reducing the insulating quality of the unit.

U.S. Pat. No. 2,235,680 teaches a multiple glazed unit having in one embodiment three glass sheets held in spaced relation by a metal strip adhered to peripheral edge portions of each glass sheet and marginal edge portions of the outer sheets. The drawback of the glazed unit taught in U.S. Pat. No. 2,235,680 is that it does not have provisions for providing a desiccating material to absorb moisture in the airspace between the glass sheets. Therefore, care has to be exercised during fabrication of the unit to assure that the air in the airspace is free of moisture. If moisture is present, it condenses on the window and obstructs the view of the observer.

U.S. Pat. No. 3,837,129 teaches a multiple glazed unit having two glass sheets and a plastic middle sheet. The middle sheet is mounted in a U-shaped member which engages the middle sheet by the extremities of the U-limbs and clamps the middle sheet by its inherent resistance. Spacers and the U-shaped member separate the outer glass sheets from the middle sheet. Although the unit taught in U.S. Pat. No. 2,837,129 is suitable for its intended purpose, there are limitations. More particularly, the unit is expensive to construct and requires three discrete spacers, namely, two metal spacers and the U-shaped member.

It would be advantageous, therefore, to provide a multiple glazed unit, e.g., a triple glazed unit that does not have the limitations and drawbacks of the multiple glazed units taught in the prior art.

SUMMARY OF THE INVENTION

This invention relates to a multiple glazed unit having a spacer mounted on at least one transparent sheet. An outer transparent sheet is mounted on each of the pair of opposed outer surfaces of the spacer with the spacer terminating short of the peripheral edges of the outer transparent sheets. Facilities secure the outer transparent sheets to the spacer.

This invention also relates to a method of fabricating a multiple glazed unit which includes the steps of mounting a spacer on edges of at least one transparent sheet and mounting transparent sheets on each of the opposed outer surfaces of the spacer with the spacer terminating short of the outer peripheral edges of the outer transparent sheets. Thereafter the outer transparent sheets are secured to the spacer.

DESCRIPTION OF THE INVENTION

In the following discussion, like numerals refer to like elements.

Figure 1:
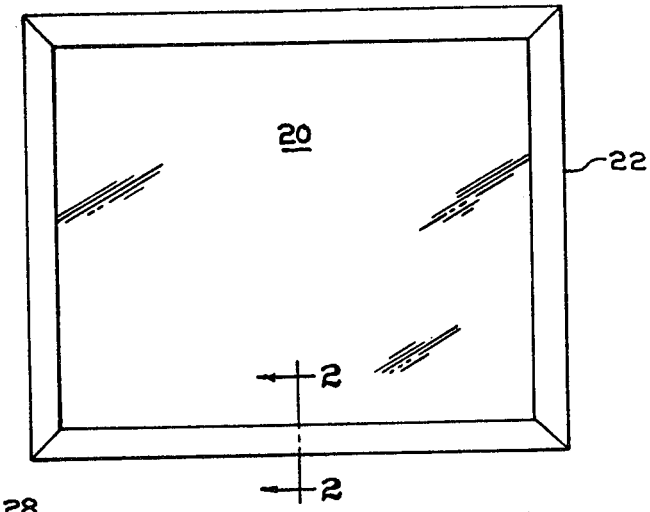
FIG. 1 is a frontal view of a triple glazed unit incorporating features of the invention mounted in a frame.

Shown in FIG. 1 is a triple glazed unit 20 mounted in a frame 22. The frame 22 may be any of the types used in the art for sliding glass doors or windows and is not limiting to the invention. Further, the multiple glazed units of the instant invention may be used in wall systems such as the type taught in U.S. Pat. No. 4,015,388 which teachings are hereby incorporated by reference.

Figure 2:
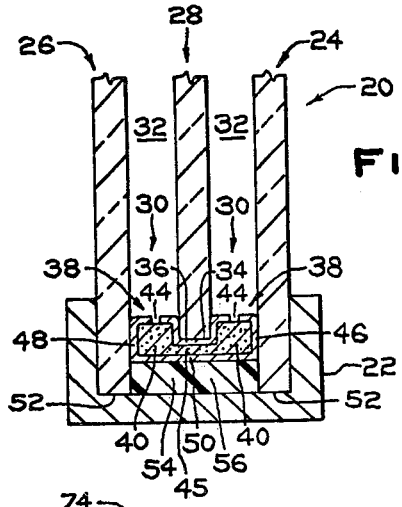
FIG. 2 is a view taken along lines 2—2 of FIG. 1.

With reference to FIG. 2, the unit 20 includes two outer transparent sheets, e.g., glass sheets 24 and 26 and an inner transparent sheet, e.g., glass sheet 28 held in spaced relation by a spacer 30 to provide an airspace 32 between adjacent glass sheets. Although the invention is discussed using glass sheets, it will become apparent that the invention is not limited thereto and may be used with any type of sheet material, for example, wood, plastic or metal. Further, the glass sheets may be tempered and/or advantageously coated to reduce passage of solar energy and/or radiant energy.

The spacer 30 as viewed in FIG. 2 has a generally U-shaped cross-section and a groove 34 for receiving edge portions 36 of the inner glass sheet 28. Legs 38 of the spacer 30 each have a cavity 40 for receiving desiccant 42. The desiccant 42 communicates with the airspaces 32 by way of holes 44 to absorb moisture captured in the airspaces 32 during fabrication of the unit 20. Although not limiting to the invention, it is recommended that the holes 44 of the spacer 30 interconnect by way of passageway 45 in the spacer 30 as shown in FIG. 2 to equalize air pressure in the airspaces 32.

The outer glass sheet 24 is mounted on opposed outer surface 46 of the spacer 30 and the glass sheet 26 is similarly mounted on the opposed outer surface 48 of the spacer 30. As shown in FIG. 2, base or peripheral surface 50, i.e., flat side of the spacer 30, is inset from peripheral edge portions 52 of the outer glass sheets 24 and 26 to form a peripheral channel 54. The peripheral channel 54 is preferably filled with a moisture-resistant adhesive 56 of the type used in the art for hermetically sealing the airspaces 32 and securing the outer glass sheets 26 and 24 about the spacer 30.

The expressions "moisture-resistant adhesive" and "hermetic seal" as used herein refer to an ability to prevent passage of water vapor. Preferably the adhesive or hermetic seal presents enough of an obstacle to water vapor transmission to preclude condensation of water vapor in the interior of the units at temperatures down to about 0° F. (i.e., about $1.77\times10^{-5}$ grams of water per cubic inch of air in the unit) and preferably lower over a period of several years. The time period required is at least about 3–5 years but preferably is at least about 10 years and in optimum cases is at least about 20 years. The amount of water vapor penetration depends not only on the inherent moisture vapor transmission of the adhesive employed as the obstacle but also on the dimensions (e.g., thickness) of the obstacle in the path of water vapor penetration. Because visual aesthetics must be considered in regard to architectural glazing, it is desired to minimize the dimensions of the water vapor barrier thus materials having a relatively low moisture vapor transmission are preferred. For this reason, it is generally preferred that the materials used for moisture vapor barriers in multiple glazing have a moisture vapor transmission of less than about 15 grams (preferably less than about 6 grams) for 24 hours/square meter/mil thickness at 100° F. (38° C.) and 90 percent relative humidity as determined by A.S.T.M. E96-66E. The desiccants are included in the multiple glazed units to absorb moisture vapor transmission in the airspace; and when a desiccant is employed, the requirements for moisture barriers may be relaxed by an amount corresponding to the water absorbing capacity of the desiccant.

Adhesives that may be used in the practice of the invention but not limiting thereto are materials that are capable of flow at room temperature and include precured materials such as taught in U.S. Pat. No. 2,974,377; room temperature curable materials such as taught in U.S. Pat. No. 3,791,910; and hot melt adhesives such as sold by H. B. Fuller Co. of Minneapolis, Minn. The teachings of the above-identified patents are hereby incorporated by reference.

Figure 3:
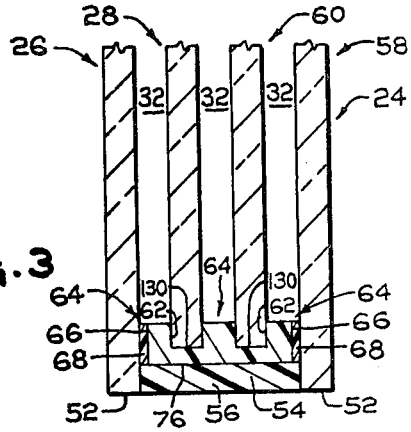
FIG. 3 is a view similar to that of FIG. 2 showing a quadruple glazed unit incorporating features of the invention.

With reference to FIG. 3, there is shown a quadruple glazed unit 58 having the two outer glass sheets 24 and 26 and two intermediate glass sheets 28 and 60. The two inner glass sheets 28 and 60 are each mounted in a groove 62 formed in a desiccative spacer 64 of the type taught in U.S. Pat. No 3,758,996 which teachings are hereby incorporated by reference. The outer glass sheets 24 and 26 are mounted on outer surfaces 66 of the desiccative spacer 64 by a layer 68 of adhesive. The adhesive layer 68 may be any of the types used in the art for adhering the outer glass sheets to the spacer 64 and may be a moisture-resistant adhesive of the types discussed above.

The spacer 64 is inset from the peripheral edge portions 52 of the outer glass sheets 24 and 26 to form the peripheral channel 54 which is filled with the moisture-resistant adhesive 56 to form a moisture-resistant seal.

Figure 4:
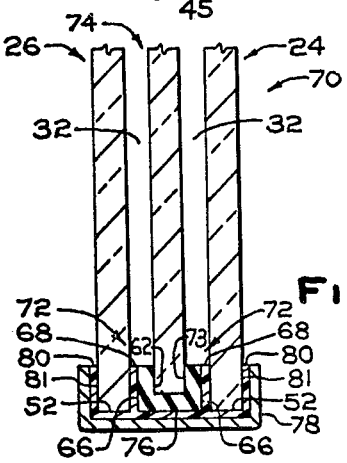
FIG. 4 is a view similar to that of FIG. 2 showing an alternate embodiment of a triple glazed unit incorporating features of the invention.

With reference to FIG. 4, triple glazed unit 70 has a spacer 72 similar to the spacer 64 of FIG. 3 except that only one groove 62 is formed in the spacer 72 for receiving edge portions 73 of an inner glass sheet 74. Outer peripheral surface 76 of the spacer 72 is generally flush with peripheral edge portions 52 of the outer glass sheets 24 and 26. As in FIG. 3, the glass sheets 24 and 26 are secured to outer surface 66 of the spacer 72 by the adhesive layer 68.

A resilient, moisture-resistant strip 78 with a layer 80 of moisture-resistant adhesive such as disclosed in U.S. Pat. No. 2,974,377, which teachings are hereby incorporated by reference is provided. The strip 78 is adhered to the peripheral edge portions 52 of the glass sheets 24 and 26, peripheral surface 76 of the spacer 72, outer surface of the adhesive layer 68 and may extend over the outer marginal edge portions 81 of the outer glass sheets 24 and 26 as shown in FIG. 4.

Figure 5:
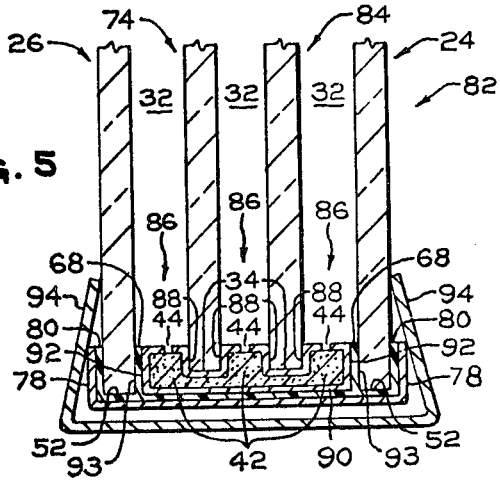
FIG. 5 is a view similar to that of FIG. 2 showing an alternate embodiment of a quadruple glazed unit incorporating features of the invention.

Quadruple glazed unit 82 shown in FIG. 5 includes the outer glass sheets 24 and 26 and two inner glass sheets 74 and 84. The inner glass sheets 74 and 84 are separated by a spacer 86 similar to the spacer 30 shown in FIG. 2 except that the spacer 86 has two grooves 34 for receiving edge portions 88 of the two inner glass sheets 74 and 84 as shown in FIG. 5. Outer peripheral surface 90 of the spacer 86 is generally flush with the peripheral edge portions 52 of the outer glass sheets 24 and 26.

The adhesive layer 68 is provided between outer surface 92 of the spacer 86 and adjacent inner marginal edge portions 93 of the outer glass sheets 24 and 26. In this instance, the adhesive layer 68 is preferably a moisture-resistant adhesive to form a moisture-resistant seal. The moisture-resistant strip 78 having the adhesive layer 80 is applied to the unit 82 in a similar manner as discussed for the unit 70 shown in FIG. 4.

A channel member 94 of essentially U-shaped cross-section also extends completely around the perimeter of the unit 82 to protect the edges. The channel member 94 generally includes several sections of channeling joined or abutted together at their ends.

Figure 6:
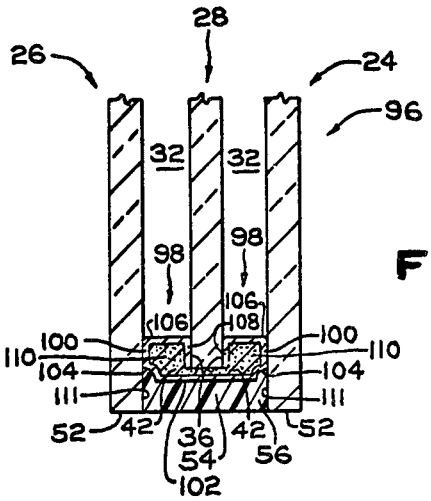
FIG. 6 is a view similar to FIG. 2 showing another embodiment of a triple glazed unit incorporating features of the invention.

Shown in FIG. 6 is a triple glazed unit 96 having the outer glass sheets 24 and 26 and the inner glass sheet 28 separated by a spacer 98. As viewed in FIG. 6, the spacer includes a pair of generally vertical outer walls 100 connected to base 102 by inwardly sloping wall portions 104. A generally horizontal wall 106 is connected to each outer wall 100 and extends over the base 102 of the spacer 98. An inner generally vertical wall 108 extends from each of the horizontal walls 106 toward the base 102.

The base 102, walls 100, 104, 106 and 108 form a cavity 110 on each side of the inner glass sheet 28 for receiving the desiccant 42. The desiccant 42 communicates with the airspaces 32 by air moving (1) between the inner walls 108 of the spacer 98 and adjacent surfaces of the inner glass sheet 28 and (2) between inner wall 108 and base 102.

Preferably the inner walls 108 of the spacer 98 are angled toward each other to snap onto edge portions 36 of the inner glass sheet 28. The peripheral channel 54 for receiving the moisture-resistant adhesive 56 is formed by the (1) inner marginal edge portions 111 of the outer glass sheets 24 and 26, (2) base 102 and (3) sloping wall portions 104 of the spacer 98.

Figure 7:
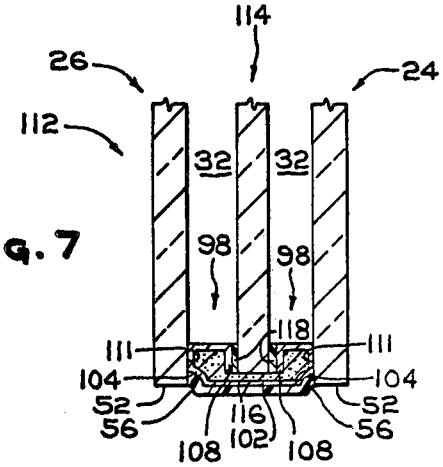
FIG. 7 is a view similar to FIG. 2 showing still another embodiment of a triple glazed unit incorporating features of the invention.

The triple glazed unit 112 of FIG. 7 is similar to the triple glazed unit 96 shown in FIG. 6 with the differences discussed below.

The unit 112 has an inner glass sheet 114 separated from adjacent glass sheets 24 and 26 by the spacer 98 to provide the airspacers 32. The inner glass sheet 114 has similar dimensions and configuration as the outer glass sheets 24 and 26.

As shown in FIG. 7, the base 102 of the spacer 98 extends beyond the peripheral edge portions 52 of the outer glass sheets 24 and 26. The outer glass sheets 24 and 26 are adhered to the spacer by the moisture-resistant adhesive 56 between sloping wall portions 104 of the spacer 98 and adjacent inner marginal edge portions 111 of the glass sheets 24 and 26.

Preferably the base 102 of the spacer 98 is covered with a layer 116 of paint or a moisture-resistant adhesive to prevent corrosion of outer exposed surfaces of the spacer 98.

To provide additional structural integrity beads 118 of adhesive may be provided between inner walls 108 of the spacer 98 and adjacent surfaces of the inner glass sheet 114.

As can now be appreciated, other embodiments within the scope of the invention can be made. For example, the spacers 30, 72 and 98 of FIGS. 2, 4 and 6 respectively are interchangeable as are spacers 64 and 86 of FIGS. 3 and 5, respectively.

DETAILED DESCRIPTION OF THE INVENTION

Example I

A pair of glass sheets 24 and 26 each having a thickness of about $\frac{1}{8}$ inch (0.32 centimeter); a length of about $60\frac{1}{2}$ inches (153.67 centimeters) and a width of about $36\frac{1}{2}$ inches (92.71 centimeters) and glass sheet 28 having a thickness of about $\frac{1}{8}$ inch (0.32 centimeter); a length of about 60 inches (1.5 meters) and a width of about 36 inches (0.9 meter) are cleaned in any conventional manner.

Figure 8:
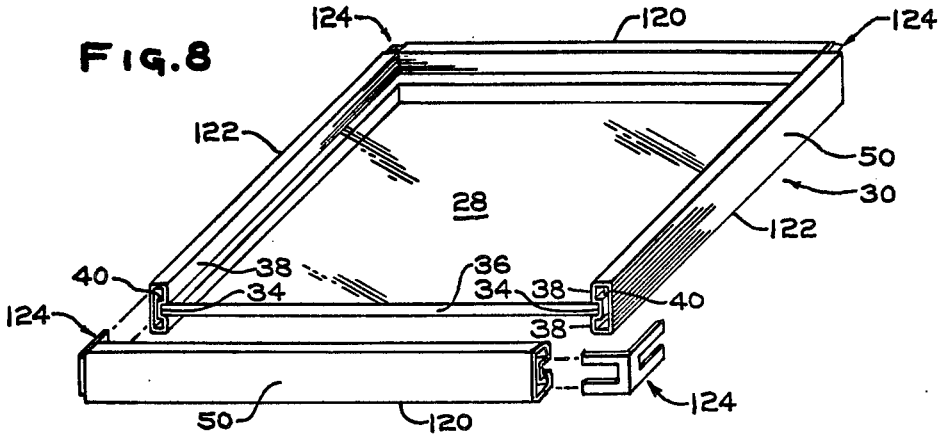
FIG. 8 is an isometric view illustrating a spacer being mounted on a transparent sheet in accordance to the teachings of the invention.

With reference to FIG 8, two spacer sections 120 having a length of about 36 inches (0.9 meter) and two spacer sections 122 each having a length of about 60 inches (1.5 meters) of a rolled galvanized steel having a generally U-shaped cross-section are provided. The sections 120 and 122 are joined together in a manner to be discussed below to provide the spacer 30 shown in FIG. 2. Each section 120 and 122 has a wall thickness of about 0.020 inch (0.05 centimeter). The sections 120 and 122 each have a height of about 5/16 inch (0.84 centimeter) and flat side or base 50 has a width of about $\frac{5}{8}$ inch. Groove 34 formed by legs 38 has a depth of about $\frac{1}{4}$ inch (0.64 centimeter) and a width of about $\frac{1}{8}$ inch (0.32 centimeter) for receiving edge portions 36 of the glass sheet 28. Spaced holes 44 (shown in FIG. 2) are provided in the legs 38 of the spacer 30.

Cavity 40 of the sections 120 and 122 are filled with silica gel 42 (shown in FIG. 2) and mounted on edge portions 36 of the glass sheet 28. Adjacent ends of the sections 120 and 122 are joined together by corner clips 124 as shown in FIG. 8.

The glass sheets 24 and 26 are mounted on the spacer 30 with the peripheral edge portions 52 of the glass sheets 24 and 26 extending about $\frac{1}{8}$ inch (0.32 centimeter) beyond the flat side 50 of the spacer 30 to provide peripheral channel 54 as shown in FIG. 2. The peripheral channel 54 is filled with Fuller HM 1081 hot melt adhesive in any conventional manner.

The unit 20 may thereafter be mounted in frame 22 in any conventional manner.

EXAMPLE II

Figure 10:
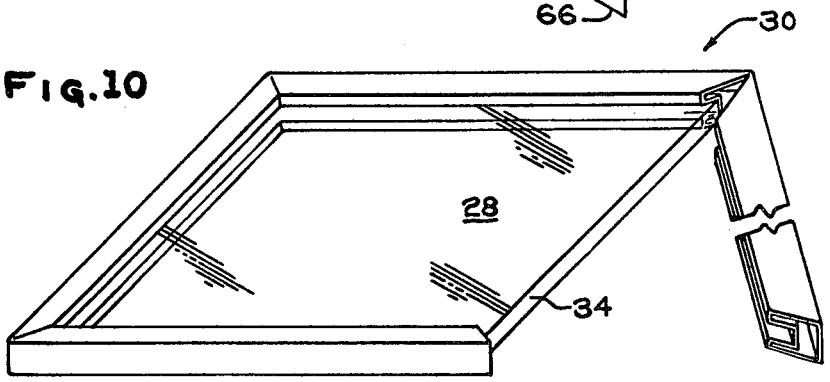
FIG. 10 is an isometric view illustrating an alternate embodiment of the invention for mounting a spacer on a transparent sheet.

The triple glazed unit of Example II is similar to that of Example I with the following exceptions. The spacer 30 is provided in one section and is mitered at the corners as shown in FIG. 10. The spacer 30 is wrapped around the edges 34 of the inner glass sheet 24 to secure the spacer 30 in position about the glass sheet 28.

EXAMPLE III

In addition to the outer glass sheets 24 and 26 and inner glass sheet 28, a second inner glass sheet 60 similar in dimensions to the glass sheet 28 is cleaned.

Figure 9:
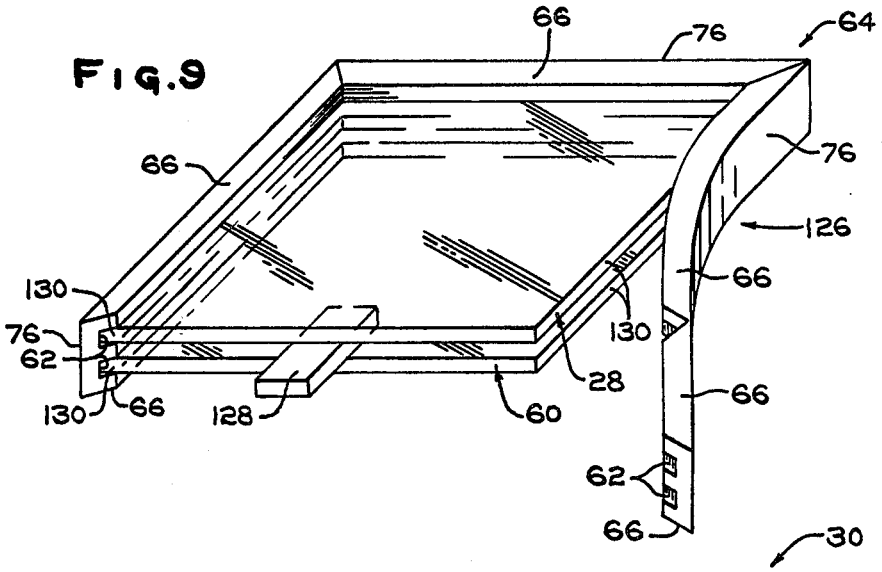
FIG. 9 is an isometric view illustrating a spacer being mounted on a pair of spaced transparent sheets in accordance to the teachings of the invention.

With reference to FIG. 9, a desiccative strip 126 having a length of greater than about 18 feet (5.4 meters) and having a generally E-shaped cross-section is provided. The desiccative strip may be of the type taught in U.S. Pat. No. 3,758,996 and is generally described as a moisture vapor transmittable matrix of a block copolymer of styrene and butadiene having interdispersed therein a desiccating material.

The desiccative strip 126 has a base or peripheral surface 76 having a width of about 1 inch (2.54 centimeters) and a height of about 5/16 inch (0.84 centimeter). Each of the legs of the "E" has a width of about $\frac{1}{8}$ inch (0.32 centimeter) and grooves 62 formed by the legs has a depth of about $\frac{1}{4}$ inch (0.64 centimeter).

With reference to FIG. 9, spacer block 128 (one shown in FIG. 9) having a thickness of about $\frac{5}{8}$ inch (0.32 centimeter) are positioned between the inner glass sheets 28 and 60. The desiccative strip 126 is wrapped around the perimeter of the inner glass sheets 28 and 60 with ones of the edge portions 130 of the sheets 28 and 60 inserted into a groove 62 as shown in FIG. 9. The desiccative strip 126 is mitered at the corner of the inner glass sheets 28 and 60 and the spacer blocks 128 removed as the desiccating strip 128 is positioned about the inner glass sheets 28 and 60 to provide the desiccative spacer 64.

Referring now to FIG. 3, a layer 68 of room temperature, vulcanizable adhesive is mounted on the outer marginal edge portions 66 of the desiccative spacer 64. Thereafter a one of the outer glass sheets 24 or 26 is mounted on one side of the spacer 64 and the other glass sheet 26 or 24 on the opposite side thereof. Pressure is applied in any conventional manner to flow the layer 68 of the adhesive to adhere the outer glass sheets to the desiccative spacer 64.

The peripheral edge portions 52 of the outer glass sheets 24 and 26 extend beyond the peripheral edge 76 of the spacer 64 to provide the peripheral channel 54.

The peripheral channel 54 is filled with a hot melt adhesive as discussed in Example I.

EXAMPLE IV

Triple glazed unit 70 shown in FIG. 4 is constructed in a similar manner as quadruple glazed unit 58 shown in FIG. 3 and discussed in Example III with the following exceptions. Spacer 72 of unit 70 is similar to spacer 64 of unit 58 shown in FIG. 3 except the base 76 of the spacer 72 has a width of about $\frac{5}{8}$ inch (1.60 centimeters) and has one groove 62 for receiving edges 73 of inner glass sheet 74. The inner glass sheet 74 and spacer 72 are sized such that the base on peripheral edge 76 of the spacer 72 is flush with the peripheral edge portions 52 of the outer glass sheets 24 and 26.

A stainless steel tape 78 having a thickness of about 0.004 inch (0.10 centimeter) has a layer 80 of a moisture-resistant adhesive such as disclosed in U.S. Pat. No. 2,974,377. The tape 78 having the moisture-resistant adhesive layer 80 is adhered to the peripheral edge portions 76 of the spacer 72, peripheral edge portions 52 of the outer glass sheets 24 and 26 and extends over onto outer marginal edge portions 81 of the outer glass sheets 24 and 26 as shown in FIG. 4.

EXAMPLE V

The quadruple glazed unit 82 of Example V is shown in FIG. 5 and is similar to that of Example II with the following exception.

Two intermediate glass sheets 74 and 84 are used and the spacer 86 is similar to the spacer 30 shown in FIG. 2. The spacer 86 has a base 90 or peripheral edge width of about 1 inch (2.54 centimeters) and a pair of spaced grooves 34 for receiving edge portions 88 of the inner glass sheets 74 and 84. The inner glass sheets 74 and 84 and spacer 86 are sized such that the base 90 of the spacer 86 is generally flush with the peripheral edges 52 of the outer glass sheets 24 and 26. A layer of moisture-resistant adhesive 68 is applied to the outer edges 92 of the spacer 86 in a similar manner as the adhesive layer 68 was applied to the outer edges 66 of the spacer 64 of FIG. 3 and discussed in Example III. The moisture-resistant tape 78 having the moisture-resistant adhesive 80 discussed in Example IV is applied in a similar manner to the peripheral edge portions of the spacer and marginal edge portions of the outer glass sheets 24 and 26.

A channel member 94 of essentially U-shaped cross-section extends completely around the perimeter of the window 82 to protect the edges and is of the type used in the art.

EXAMPLE VI

The inner glass sheet 28 of Example I are used in the construction of the triple glazed unit shown in FIG. 6. The outer glass sheet 24 and 26 each have a thickness of about $\frac{1}{8}$ inch (0.32 centimeter), a length of about $60\frac{1}{4}$ inches (153 centimeters) and a width of about $36\frac{1}{4}$ inches (92 centimeters).

Figure 11:
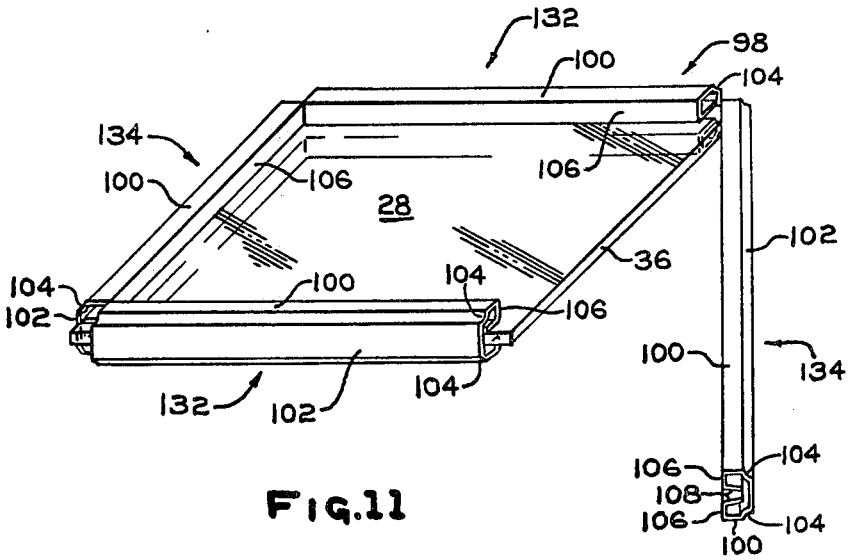
FIG. 11 is an isometric view illustrating still another embodiment of the invention for mounting a spacer on a transparent sheet.

With reference to FIG. 11, two sections 132 each having a length of about $59\frac{1}{2}$ inches (141.13 centimeters) and two sections 134 each having a length of about $35\frac{1}{2}$ inches (90.17 centimeters) are provided to form the spacer 98. Each of the sections 132 and 134 of the spacer 98 has a base 102 having a width of about $\frac{1}{2}$ inch (1.27 centimeters) and a wall thickness of about 0.020 inch (0.05 centimeter). A pair of vertical outer walls 100 having a height of about $\frac{1}{8}$ inch (0.32 centimeter) has inwardly sloping wall portions 104 connecting the outside walls 100 to the base 102 to provide the spacer 98 with an overall height of about $\frac{3}{8}$ inch (0.96 centimeter). A horizontal wall 106 having a length of about $\frac{1}{4}$ inch (0.64 centimeter) is connected to each of the outer walls 100 and extends toward each other over the base 102. An inner vertical wall 108 having a length of about 5/16 inch (0.80 centimeter) extends from the horizontal wall 106 toward the base 102. The inner walls 108 are spaced about $\frac{1}{8}$ inch (0.32 centimeter) apart at their upper portion and about 3/32 inch (0.24 centimeter) at their free end.

The sections 132 and 134 are mounted on the edge portions 36 of the glass sheet 28 and terminate short of the corners glass sheet 28 as shown in FIG. 11.

The outer glass sheets 24 and 26 are mounted on outer walls 100 of the spacer 98 with the peripheral edges 52 of the outer glass sheets 24 and 26 extending beyond the base 102 of the spacer 98 to form a peripheral channel 54 as shown in FIG. 6. The peripheral channel 54 is filled as taught in Example I.

When filling the peripheral channel 54 of the unit of Example VI, the moisture-resistant adhesive 56 also fills the space between the inner glass sheet 28 and outer glass sheets 24 and 26 at the corners thereof.

EXAMPLE VII

Triple glazed unit 112 shown in FIG. 7 is constructed in a similar manner as the triple glazed unit 96 shown in FIG. 6 and discussed in Example VI with the following exceptions.

Inner glass pane 114 has generally the same shape and dimensions as outer glass sheets 24 and 26. Beads 118 of adhesive are provided between the inner walls 108 of the spacer 98 and adjacent surfaces of the inner glass sheet 28, as shown in FIG. 7.

In unit 112, the base 102 of the spacer 98 extends beyond the peripheral edges 52 of the outer glass sheets 24 and 26. A layer 116 of the moisture-resistant adhesive is provided between the inner marginal edges 111 of the outer glass sheets 24 and 26 and sloping wall portion 104 of the spacer 98 and over the base 102 of the spacer 98. The corners of the unit 112 are filled in a similar manner as the corners of the unit 96 shown in FIG. 6 and discussed in Example VI.

The multiple glazed units of the instant invention are easier and more economical to construct than similar prior art units. The units of the instant invention are easier to construct because alignment of the two spacers and three glass sheets is eliminated by mounting the spacer on the inner sheet. The units of the instant invention are more economical to construct because only one spacer is needed for a triple glazed unit whereas two spacers are normally needed for triple glazed units of the prior art.

As can be appreciated, the above examples are merely illustrative of different embodiments of the invention and that the invention is not limited thereto.

What is claimed is:

1. A multiple glazed unit, comprising:

a spacer mounting at least one sheet, said spacer comprising at least one spacer section, said at least one spacer section as viewed in a plane normal to major surface of the at least one sheet having a base continuous with a pair of spaced legs and at least one groove between said pair of spaced legs for mounting said spacer section on marginal edge portions of said at least one sheet;

a first outer sheet having marginal edge portions contiguous with outer surface of a leg;

a second outer sheet having marginal edge portions contiguous with outer surface of the remaining leg;

said base of said spacer terminating short of peripheral edge portions of said outer sheets;

said spacer maintaining adjacent sheets in spaced relation to provide an airspace therebetween; and means for maintaining said outer sheets against said spacer legs.

2. The multiple glazed unit as set forth in claim 1 wherein said base of said spacer is substantially flush with peripheral edge portions of said outer sheets.

3. The multiple glazed unit as set forth in claim 1 wherein at least one of the sheets is a glass sheet.

4. The multiple glazed unit as set forth in claim 1 wherein opposed inner surfaces of said at least one groove are angled toward one another.

5. The multiple glazed unit as set forth in claim 1 wherein an adhesive is between the outer marginal edge portions of said at least one sheet and adjacent walls of said at least one groove.

6. The multiple glazed unit as set forth in claim 1 wherein said base of said spacer is spaced inwardly from peripheral edge portions of said outer sheets to provide a peripheral channel and said maintaining means includes an adhesive in said peripheral channel adhered to said spacer base and said adjacent sheet surfaces.

7. The multiple glazed unit as set forth in claim 6 wherein said spacer contains a desiccant; said adhesive is a moisture-resistant adhesive and further including means for providing communication between the airspaces and said desiccant.

8. A multiple glazed unit, comprising:

a spacer mounting at least one sheet, said spacer comprising at least one spacer section, said at least one spacer section as viewed in a plane normal to major surface of the at least one sheet having a base continuous with a pair of spaced legs and at least one groove between said pair of spaced legs for mounting said spacer section on marginal edge portions of said at least one sheet;

first and second sheets;

adhesive layer having one side on outer surface of said pair of said spaced spacer legs and opposed surface of said adhesive layer on inner marginal edge portions of each of said first and second sheets to secure said sheets about said spacer;

said base of said spacer terminating short of peripheral edge portions of said first and second sheets; and said spacer maintaining said first and second sheets in spaced relation to provide an airspace between adjacent sheets.

9. The multiple glazed unit as set forth in claim 8 wherein said base of said spacer is generally flush with said peripheral edge portions of said first and second outer sheets.

10. The multiple glazed unit as set forth in claim 8 wherein said base of said spacer is spaced outwardly of said peripheral edge portions of said first and second outer sheets.

11. The multiple glazed unit as set forth in claim 8 wherein opposed inner surfaces of said at least one groove are angled toward one another.

12. The multiple glazed unit as set forth in claim 8 wherein at least one of the sheets is a glass sheet.

13. The multiple glazed unit as set forth in claim 8 wherein an adhesive is between the outer marginal edge portions of said at least one sheet and adjacent walls of said at least one groove.

14. The multiple glazed unit as set forth in claim 8 wherein said spacer contains a desiccant; said adhesive is a moisture-resistant adhesive and further including means for providing communication between the airspaces and said desiccant.

15. The multiple glazed unit as set forth in claim 8 wherein said base of said spacer is spaced inwardly from peripheral edge portions of said first and second sheets to form a peripheral channel.

16. The multiple glazed unit as set forth in claim 15 wherein said peripheral channel is filled with a moisture-resistant adhesive.

* * * * *